US009068451B2

(12) United States Patent
Lund et al.

(10) Patent No.: US 9,068,451 B2
(45) Date of Patent: Jun. 30, 2015

(54) TREATMENT OF PRODUCED HYDROCARBON FLUID CONTAINING WATER

(75) Inventors: Are Lund, Trondheim (NO); Roar Larsen, Ranheim (NO); Jon Harald Kaspersen, Trondheim (NO); Erlend Oddvin Straume, Trondheim (NO); Martin Fossen, Trondheim (NO); Kai W. Hjarbo, Ranheim (NO)

(73) Assignee: Sinvent AS, Trondheim (NO)

( * ) Notice: Subject to any disclaimer, the term of this patent is extended or adjusted under 35 U.S.C. 154(b) by 426 days.

(21) Appl. No.: 12/761,039

(22) Filed: Apr. 15, 2010

(65) Prior Publication Data

US 2011/0220352 A1 Sep. 15, 2011

Related U.S. Application Data

(60) Provisional application No. 61/312,790, filed on Mar. 11, 2010.

(51) Int. Cl.
*E21B 43/34* (2006.01)
*F17D 3/14* (2006.01)

(52) U.S. Cl.
CPC .. *E21B 43/34* (2013.01); *F17D 3/14* (2013.01)

(58) Field of Classification Search
CPC ..... F17D 3/34
USPC ..... 210/170.11, 708–712; 507/90; 585/15
See application file for complete search history.

(56) References Cited

U.S. PATENT DOCUMENTS 5,460,728 A 10/1995 Klomp et al.
5,816,280 A 10/1998 Rojey et al.

(Continued)

FOREIGN PATENT DOCUMENTS

EP 1 790 927 A2 5/2007
WO 00/25062 5/2000

(Continued)

OTHER PUBLICATIONS

International Search Report and Written Opinion of the International Searching Authority issued Jul. 29, 2011 in corresponding International Application No. PCT/NO2011/000081.

(Continued)

*Primary Examiner* — Tony G Soohoo
*Assistant Examiner* — Peter Keyworth
(74) *Attorney, Agent, or Firm* — Wenderoth, Lind & Ponack, L.L.P.

(57) ABSTRACT

A method for treating a flow of fluid hydrocarbons containing water includes introducing the flow of fluid hydrocarbons into a first separator and separating at least free water from said flow of fluid hydrocarbons, wherein a remainder of said fluid hydrocarbon flow is introduced into a system converting free/condensed water in the fluid hydrocarbon flow in said system to gas hydrates, and providing at least a first fluid flow and a second fluid flow, wherein said first fluid flow is a liquid phase including gas hydrates, said first fluid flow is recycled into the first separator, and wherein the second fluid flow has a content of dry gas and/or condensate/oil. A system for treatment of a flow of fluid hydrocarbon fluid containing water includes the following elements listed in the flow direction and connected with each other: connection to a hydrocarbon production source (1), a first separator (3) operative to separate at least free water from said fluid flow, a converting system (5) for converting free/condensed water to gas hydrate, a pipeline (6, 18) for transporting a dry gas or condensate/oil; and in addition a line (7') which leads from the converting system (5) to the first separator (3) providing a first recycling flow including gas hydrates.

20 Claims, 3 Drawing Sheets

(56) References Cited

U.S. PATENT DOCUMENTS

| | | | | |
|---|---|---|---|---|
| 5,877,361 | A * | 3/1999 | Rojey et al. | 585/15 |
| 6,180,843 | B1 | 1/2001 | Heinemann et al. | |
| 6,774,276 | B1 * | 8/2004 | Lund et al. | 585/899 |
| 2002/0120172 | A1 | 8/2002 | Waycuilis et al. | |
| 2005/0194299 | A1 * | 9/2005 | Max | 210/177 |
| 2006/0260468 | A1 * | 11/2006 | Amin | 95/153 |
| 2007/0054812 | A1 | 3/2007 | Lugo et al. | |
| 2007/0108131 | A1 | 5/2007 | Skjetne et al. | |

FOREIGN PATENT DOCUMENTS

| | | |
|---|---|---|
| WO | 2007/095399 | 8/2007 |
| WO | 2008/056250 | 5/2008 |
| WO | 2009/058027 | 5/2009 |

OTHER PUBLICATIONS

R. Larsen et al., "Conversion of Water to Hydrate Particles", SPE Annual Technical Conference and Exhibition, vol. SPE-71550, Sep. 20, 2001, pp. 1-5, XP009149216.

Search Report issued Nov. 2, 2010 in corresponding Norwegian Application No. 20100542.

* cited by examiner

TREATMENT OF PRODUCED HYDROCARBON FLUID CONTAINING WATER

This application claims the benefit of U.S. Provisional Application No. 61/312,790, filed Mar. 11, 2010.

INTRODUCTION

The invention concerns a system for treating a flow of fluid hydrocarbons containing water, and a method for such treatment.

BACKGROUND

Some of the world's largest gas fields are found offshore in deep water (e.g. Ormen Lange) or in remote areas in the arctic (e.g Snøhvit and Shtockman). The usual way today to transport such unprocessed well fluids in a pipeline to a landside terminal is by adding monoetylene glycol (MEG) at the wellheads. This requires large infrastructure and cost in order to inject and regenerate MEG.

For very long pipelines (e.g. Shtockman), processing and drying (water) of the gas phase may be needed prior to subsea pipeline transportation, e.g. at a platform or a ship. A full gas drying, e.g. by a tri ethylene glycol (TEG) process, will here require significant space and weight.

One common way to solve water problems and to minimize the hydrate problems in the industry, is to use glycol injection/adsorption and regeneration in a closed glycol system. Though in widespread use, such systems are plagued with a host of recurring problems—most of which can be traced back to poor efficiency of the first-stage separator for a well fluid. Glycol processes are dependent on such separation being able to remove liquid hydrocarbons and water, solids, corrosion inhibitors, etc. That task is formidable, and results in high-cost equipment and high operating costs.

Though much focus is presently on gas fields and avoidance of their water problems, many of the same problems also appear in liquid-rich oil/condensate systems, where even small fractions of water in the total system may over time lead to significant problems or flow blockages. Water and its solidification is thus a general problem for modern oil and gas production systems.

U.S. Pat. No. 6,774,276 is used as one possible way to precipitate hydrate particles from the water in the system. In U.S. Pat. No. 6,774,276 water is made transportable in the pipeline with the hydrocarbon fluid to shore or to a central platform by converting water from the well fluids to hydrate.

SUMMARY OF THE INVENTION

The present invention provides a method and a system for treating a production flow of gas, hydrocarbon liquid and water from a hydrocarbon production field in a simple system and enabling further processing and/or transport of the desired products through a transportation system, including one or more pipelines.

In a first aspect the invention provides a method for treating a flow of fluid hydrocarbons containing water, wherein the flow of fluid hydrocarbons is introduced into a first separator separating at least free water from said flow of fluid hydrocarbons, wherein a remainder of said fluid hydrocarbon flow is introduced into a system converting free/condensed water in the fluid hydrocarbon flow in said system to gas hydrates, and providing at least a first fluid flow and a second fluid flow, wherein said first fluid flow is a liquid phase comprising gas hydrates, said first fluid flow is recycled into the first separator, and wherein the second fluid flow having a content of dry gas and/or condensate/oil.

The fluid flow may be a production flow from at least one wellbore. The flow of fluid hydrocarbons may alternatively be a production flow from a gas field, and wherein separating in the first separator comprising separating free water and liquid condensate from said production flow and introducing a gas phase into the converting system. The first fluid flow may contain gas hydrate particles and condensate/oil.

In an embodiment the first separator may have a temperature above a hydrate equilibrium temperature for the fluid flow. The gas hydrates may be melted in said first recycled fluid flow to free water and/or free gas/condensate/oil in the first separator. Heat may be added to the first separator if the temperature of the flow of fluid hydrocarbons is too low. The recycled first fluid flow may also be used as a counter current flow cooling the remaining fluid hydrocarbon flow from the first separator before the remaining hydrocarbon flow enters the reactor.

An excess water aqueous phase may be separated out from said first separator, wherein said excess water is re-injected into a reservoir, or depressurized, cleaned of hydrocarbons and released to the surroundings, or it may be used for any other suitable purpose. Condensate/oil may also be separated out from said first separator, wherein said condensate/oil is stored at the field, transported in a ship or a separate pipeline, or mixed with a fluid flow containing condensate/oil from said converting system. For a liquid-dominated system the dry gas, and/or the dewatered oil/condensate may be separated out from said first separator, wherein said dry gas and/or dewatered oil/condensate are further processed or provided to a pipeline for transport.

Salt may be added to said remaining fluid hydrocarbon flow decreasing a partial water vapor pressure (water dew point) over hydrate and controlling the growth of said hydrates. The added salt may be one of formation water from the first separator, seawater or direct salt injection. A water dew point in said second fluid flow may be decreased by using at least one molecular sieve.

In an embodiment the converting system entails mixing the remaining hydrocarbon fluid flow in a reactor with particles of gas hydrates which are also introduced into said reactor, the effluent flow of hydrocarbons from the reactor is cooled in a heat exchanger to ensure that all water therein which can be converted to hydrates is in the form of gas hydrates, said flow is then treated in a second separator to be separated into the first flow and the second flow, and further separating a third flow from said first flow, wherein said third flow is recycled to the reactor to provide the particles of gas hydrates, and wherein a remaining part of the first flow is recycled into the first separator. The liquid fluid phase in the converting system may originate from condensed liquid hydrocarbons from said flow of fluid hydrocarbons or any other suitable fluid.

A first concentration of gas hydrate in said first flow and a second concentration of gas hydrates in said third flow may be controlled. Further, the first flow may comprise a first concentration of gas hydrate and said third flow comprising a second concentration of gas hydrates, wherein said first concentration is less than the second concentration. The second concentration of said gas hydrates is preferably larger than 0.5 vol %.

A concentration of salt in said remaining hydrocarbon flow or said third recycled fluid flow may be increased, providing decreasing a partial water vapor pressure (water dew point) over hydrate in said hydrocarbon flow and controlling the growth of said hydrates. A temperature in said second separator may be kept near or slightly above a minimum temperature in an export pipeline for said dry gas and/or condensate/oil.

In a second aspect the invention provides a system for treatment of a flow of fluid hydrocarbon fluid containing water, said system including the following elements listed in the flow direction and connected with each other: connection to a hydrocarbon production source, a first separator operative to separate at least free water from said fluid flow, a converting system for converting free/condensed water to gas hydrate, a pipeline for transporting a dry gas or condensate/oil; and in addition a line which leads from the converting system to the first separator providing a first recycling flow comprising gas hydrates.

A pressure control valve or choke may be provided between the hydrocarbon source and the first separator providing lowering of a pressure and temperature of the fluid flow before entering the separator.

The first separator may in be provided with an outlet for an excess aqueous phase. The first separator may be provided with an outlet for a hydrocarbon liquid condensate/oil, wherein said liquid condensate/oil is subsequently stored, transported, or mixed with the dry gas fluid flow in the pipeline.

A first cooler for cooling the fluid flow before entering the converting system may be provided. The first recycling flow may be a countercurrent in said first cooler. Further, an adding means for adding different chemicals to the flow of hydrocarbons may be provided. A second adding means for adding salt to the fluid flow decreasing a partial water vapor pressure (water dew point) over hydrate, and controlling hydrate particle size and morphology may also be provided. The salt may be one of formation water from the first separator, sufficiently clean seawater or provided from direct salt injection. At least one molecular sieve may be provided in the fluid flow line leading from the converting system further decreasing the water dew point.

In an embodiment, the converting system may comprise a reactor, a cooler, and a second separator providing the first recycling flow in the line leading from the converting system to the first separator. The converting system may further comprise a third separator in said line separating said first recycled flow into a second recycling flow leading back to the reactor and a remaining part of the first recycling flow leading to the first separator. The converting system may further be provided with a pumping device in said line between the second separator and the third separator. The converting system may be provided with at least one pump or compressor. The system may be placed subsea, on a platform or onshore. The first separator, second separator, and third separator and pump may be placed on a platform or a ship. The reactor and cooler may be an uninsulated pipeline at a sea bottom. The liquid fluid phase in the converting system may originate from condensed liquid hydrocarbons from fluid flow or any other fluid suitable for the process in the converting system. The hydrocarbon production source may be a gas field or condensate/oil field, and wherein at least one satellite well is directly connected to the converting system.

A more compact and economic process for condensate and water takeout from a wellhead gas stream, or water removal from an oil flow, may be obtained by the present invention situated at/near the wellhead/production platform/ship or subsea. Warm wellhead fluid (gas/condensate/oil/water) is here passed into a first separator where free water or condensate/oil and free water are separated from the fluid stream. Unlike a traditional first separator, e.g. used in a TEG process for a gas field, this separator also contains an inlet for a fluid stream of condensate/oil and gas hydrates. The temperature in the separator is above the hydrate equilibrium temperature, ensuring melting of all incoming hydrates. The hydrate containing fluid is obtained by drying of the gas or gas/condensate/oil stream from the given first separator by a system as e.g. described in U.S. Pat. No. 6,774,276 as mentioned above. While U.S. Pat. No. 6,774,276 aims to make water transportable, the present invention preferably removes water from the production stream. Dry gas from the present invention is preferably exported to a pipeline. Excess condensate/oil is drained from the separator and exported in a pipeline or degassed before storage. Liquid water from the given separator is reinjected in a field, or heated/degassed and cleaned before being released to sea. Alternatively, for a liquid-dominated system, the dry gas, and dewatered oil or condensate may go on to further processing, or to pipeline transport.

The present invention may be conducted at or near wellhead pressure, which may eliminate the need for export compressors at the field. The need of chemicals (e.g. MEG) to the export pipeline may be eliminated or reduced to e.g. handle corrosion.

In many cases it is advantageous to add different chemicals to the flow of hydrocarbons. The system may accordingly contain a means for adding such chemicals to the flow.

In the present invention system (5) may be any system suitable for the purpose, but may preferably make use of U.S. Pat. No. 6,774,276 as an integral part. Other systems for converting free water/condensed water to gas hydrates may alternatively be used, as e.g. described in US patent application 2002/0120172, U.S. Pat. No. 5,460,728 (or one of the many similar applications), WO 2007/095399, WO 2008/056250, or by use of choking to cool the stream and precipitate hydrates, or any other suitable means to achieve a hydrate particle laden slurry flow.

An additional new inventive aspect compared to U.S. Pat. No. 6,774,276 is introduced by the present invention through the water dew point effects which will occur due to any salts present in the aqueous phase. In addition to lowering the water dew point (and thus controlling hydrate formation) other beneficial effects of salt-containing water contribute to the novelty of this invention. As described in U.S. provisional 61/312,790, the presence of salt, or the addition of salt (or other thermodynamic hydrate inhibitor compound like e.g. methanol or glycol), helps to control the hydrate formation process by keeping local conditions close to thermodynamic equilibrium. Salt on its own also helps control and limit the size of hydrate particles and aids the avoidance of enclosed, unreacted water, which would otherwise pose a deposition and agglomeration risk.

Compared with prior art in glycol injection/adsorption and regeneration systems, the present invention simplifies the problem considerably, by allowing the first stage separator to be a simpler design, as the downstream system here is much less sensitive to the contents of the production stream. The first stage separator here only needs to remove the major part of free, condensed water, and act as a heating vessel for generated gas hydrates, with no need for pre-cooling to promote condensation.

Water condensation is in the present invention promoted onto gas hydrates in later stages of the process, with much higher water 'removal' efficiency than most first-stage separators. In systems with saline water, the present invention also achieves a further amount of protection by lowering the water dew point well below the operation temperatures, as water is promoted in the presence of saline solutions. This simplification also means that the present invention is an energetically favourable technology compared to glycol systems, both for onshore and offshore applications.

The ability to let the production stream flow at high pressure throughout the system of the present invention, also means that energy is saved compared to sometimes large recompression needs in traditional technology. Additionally, weight savings on offshore facilities (through e.g. the removal of a glycol regeneration system) are important, and can be made possible by the present invention.

BRIEF DESCRIPTION OF DRAWINGS

Example embodiments of the invention will now be described with reference to the following drawings, where.

DETAILED DESCRIPTION

Figure 1:
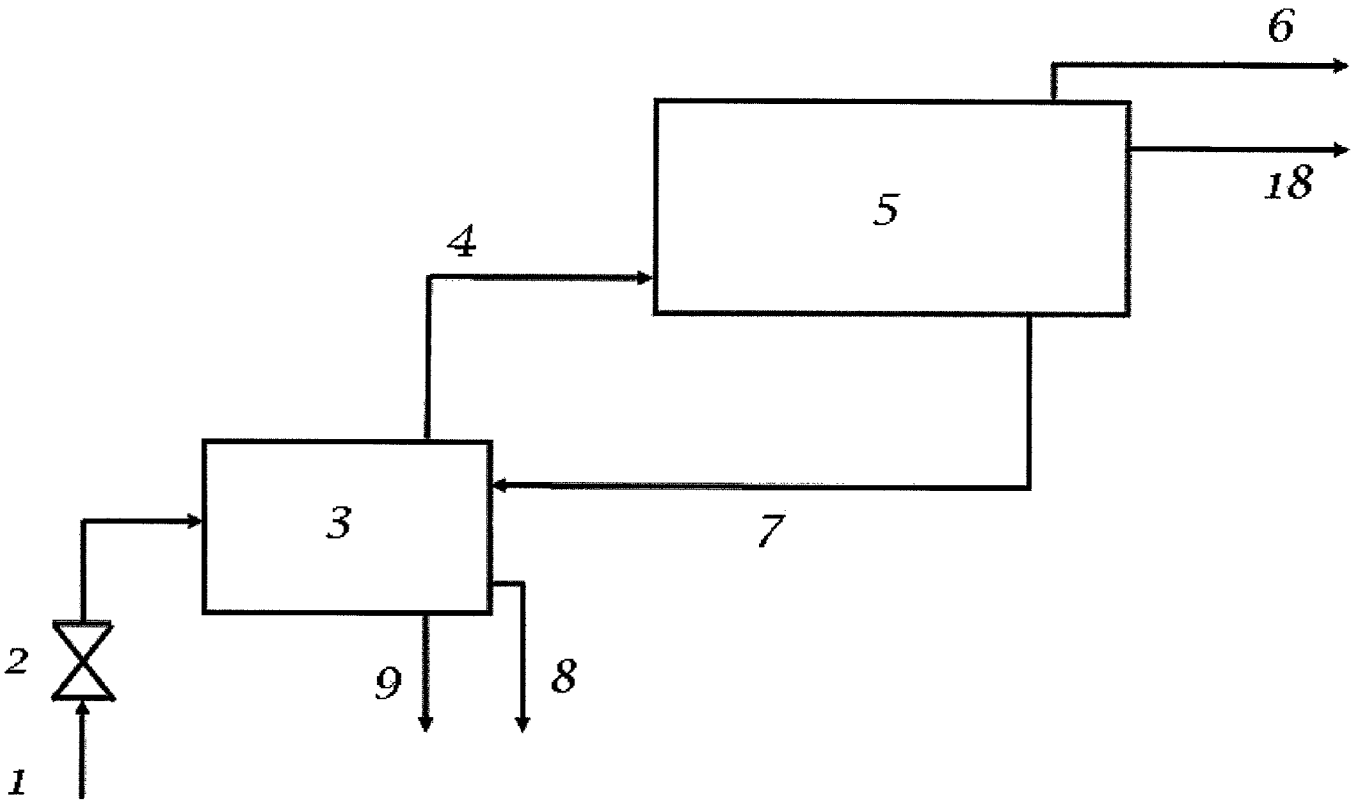
FIG. 1 is a schematic illustration of a treatment and transportation system for produced hydrocarbons containing water according to an embodiment of the invention.

The same reference numerals are used for similar or corresponding features in all the drawings.

Reference is made to FIG. 1. A production fluid flow of hydrocarbons and water (1) is introduced into a first separator (3) together with a fluid flow (7) containing gas hydrate and condensate/oil. In separator (3) the temperature is sufficiently high to melt all incoming hydrates into free water. In separator (3) most free water is separated from the production flow (1). At the same time hydrates in fluid flow (7) are melted to free water and gas/condensate/oil in separator (3). The remainder of the production flow (1) and fluid flow (7), which is gas/condensate/oil, is taken out (4) of separator (3) and introduced into a system (5). Condensate/oil may also be taken out (8) of separator (3) and stored at the field, transported in a ship or a separate pipeline, or mixed with a fluid flow (18) containing condensate/oil from system (5). Separator (3) may be any type of separator.

In system (5), which may be any system suitable for the purpose, the fluid flow (4) is cooled in order to convert any free or condensed water from fluid flow (4) into gas hydrates. The resulting fluid flow in system (5) is then after treatment, separated into an essentially dry gas (6) (with a water dew point below ambient conditions), a condensate/oil phase (18) (condensate/oil fields), and a liquid slurry phase including hydrocarbon liquid and gas hydrates (i.e., fluid flow 7). Fluid flows (6) and (18) may be combined in a single fluid flow.

Said flow (1) of fluid hydrocarbons (gas/condensate/oil), will normally come from one or more drilling hole wells and will be relatively warm and will be under pressure. It may sometimes be advantageous to attain a lower pressure and temperature in fluid flow (1) by passing the fluid flow through a choke (2) before introducing the fluid flow into separator (3). Choke (2) may be any type of choke.

Flow (9) separated out from the first separator (3), consisting mainly of water from production flow (1) and from melted hydrates in the liquid slurry phase (i.e., fluid flow (7)), may be re-injected into a reservoir, it may be depressurized, cleaned of hydrocarbons and released to the surroundings, or it may be used for any other suitable purpose.

In some embodiments, saline water may advantageously be added to system (5) to enhance the water dew point reduction in the dry gas (6) separated out from system (5).

Figure 2:
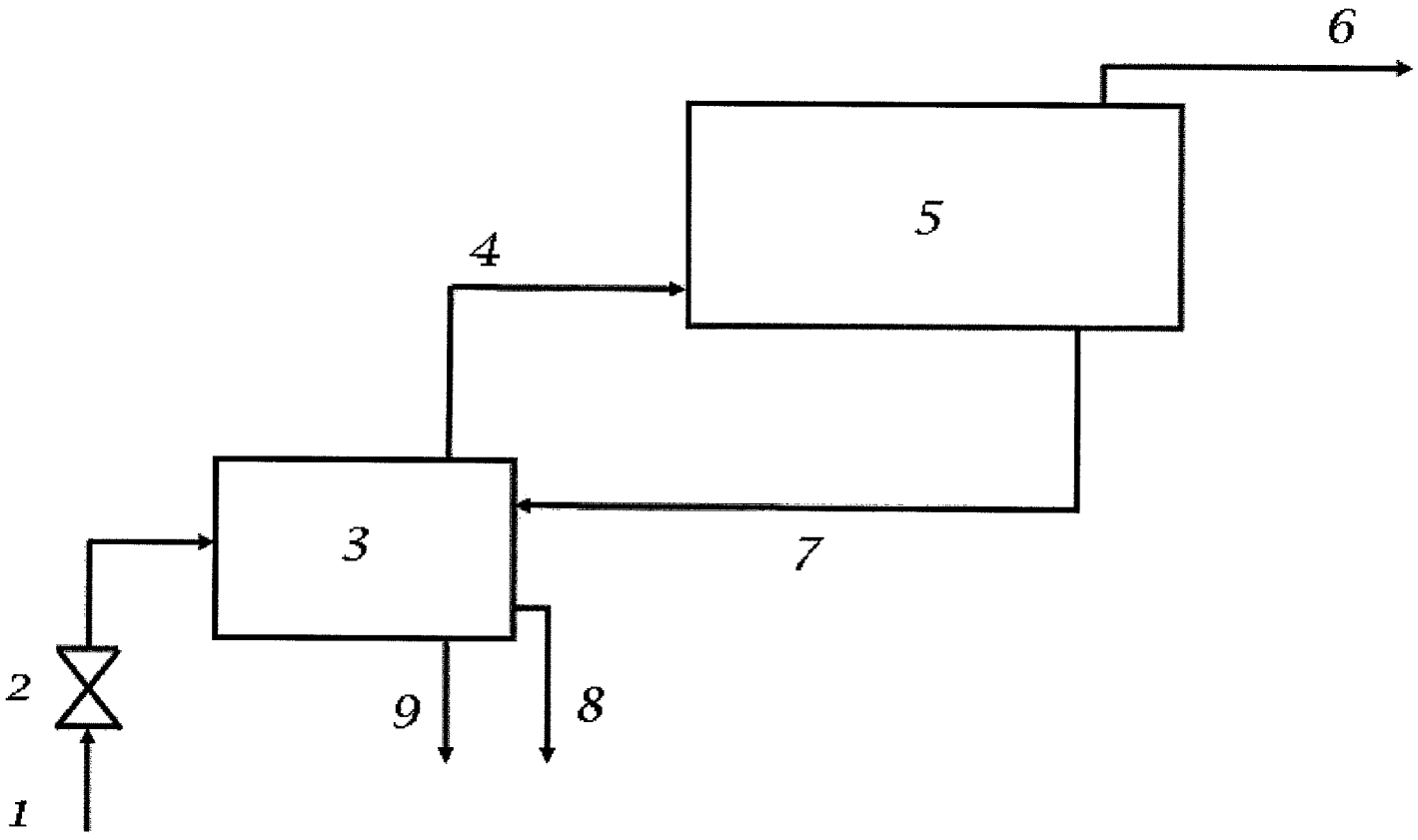
FIG. 2 is a schematic illustration of a further embodiment of the invention.

Referring to FIG. 2, in this embodiment, a production flow (1) from a gas field is entered into a first separator (3). The first separator has a temperature above hydrate equilibrium temperature for the fluid flow. A fluid flow (7) containing gas hydrate particles and condensate is also introduced into separator (3). In the first separator (3) liquid condensate and free water is separated from the production flow (1). At the same time hydrates in the fluid flow (7) are melted to free water and gas in the first separator (3). The remainder of the production flow, which is a gas phase, is taken out (4) and introduced into a system (5). In system (5), any free water in the gas phase flow (4) or condensed water in system (5) is converted into gas hydrate before returned to separator (3) as the fluid flow (7). Any condensate in the gas phase flow (4) or condensate condensed in system (5) is also returned to separator (3) by the fluid flow (7). Condensate in separator (3) is taken out (8) and stored at the field, transported in ship or a separate pipeline, or mixed with a fluid flow (6) containing dry gas from system (5). Water in separator (3) is taken out through an outlet (9) and either processed or re-injected in a reservoir.

In system (5), which may be any system suitable for the purpose, the gas phase fluid flow (4) is cooled in order to convert any free or condensed water from gas phase fluid flow (4) into gas hydrate. Vapor hydrocarbons in (4) may also condense to liquid in this process. The resulting fluid flow in system (5) is then after treatment, separated in system (5) into an essentially dry gas (6) (with a water dew point below ambient conditions), and a liquid slurry phase including hydrocarbon liquid and gas hydrates (i.e., fluid flow 7). On average, equal amounts (except for the remaining vapor in (6)) of water (in the form of hydrates and water) and condensate added to system (5) in fluid flow (4) are returned from system (5) to separator (3) by the fluid flow (7) (liquid slurry phase). In separator (3) the hydrates are melted to liquid water and free gas by the temperature level.

The production flow (1) will generally come from one or more drilling hole wells, and will be relatively warm and under pressure. It may be advantageous to attain a lower pressure, and at the same time somewhat cool the production flow, by flowing it through an expansion valve (2) before introducing it into separator (3).

Flow (9) separated out from the first separator (3), consisting mainly of water from production flow (1) and from melted hydrates in the fluid flow (7), may be re-injected into a reservoir, it may be depressurized, cleaned of hydrocarbons and released to the surroundings, or it may be used for any other suitable purpose.

In some embodiments, saline water may advantageously be added to system (5) to enhance the water dew point reduction in the dry gas (6) separated out from system (5).

Figure 3:
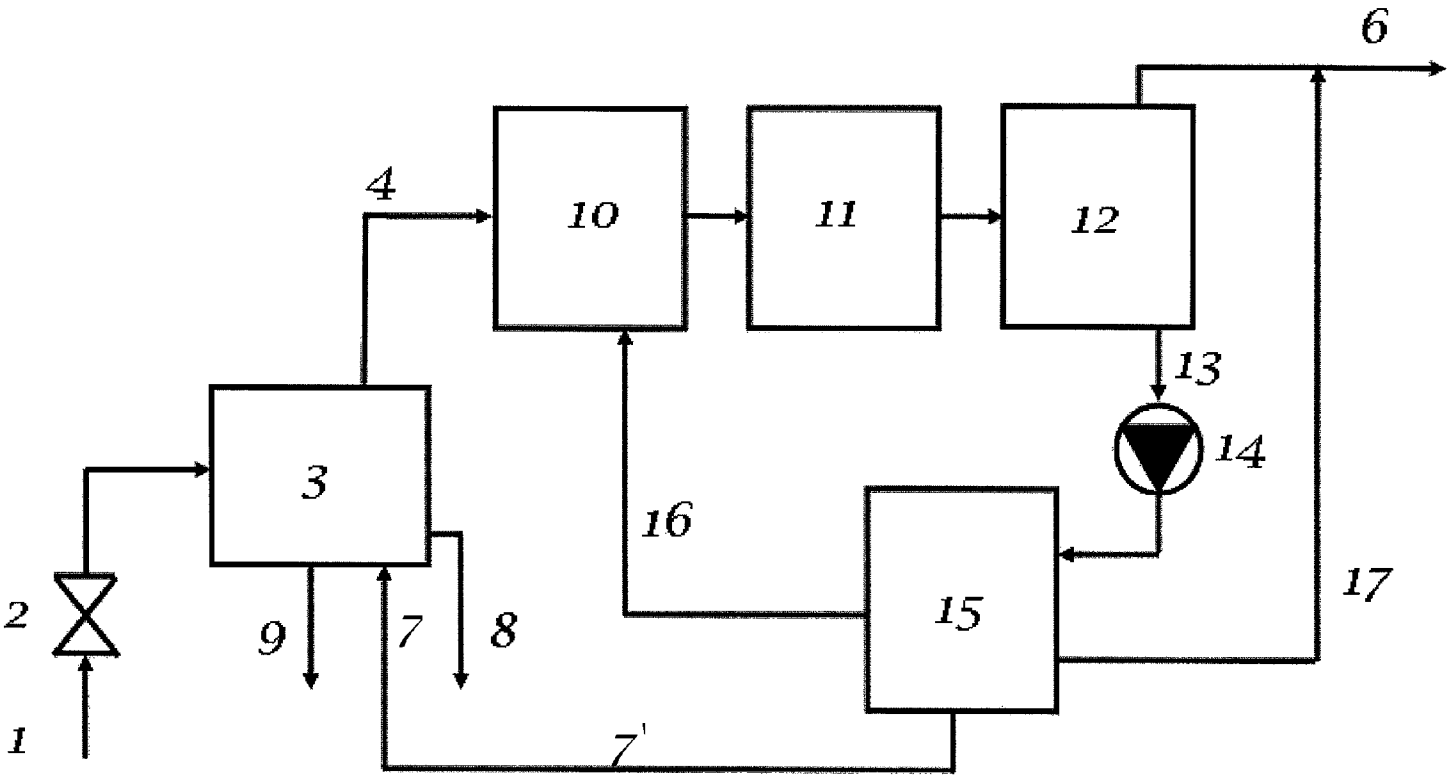
FIG. 3 is a schematic illustration of an even further embodiment of the invention.

Reference is made to FIG. 3. In this embodiment, a fluid flow of hydrocarbons and water (1) is introduced into a first separator (3) together with a fluid flow (7) containing gas hydrate and condensate. In separator (3) the temperature is sufficiently high to melt all incoming hydrates into free water. If the temperature from fluid flow (1) is too low for this purpose, heat may be added to separator (3) by any given means. Separator (3) may be any type of separator.

Said flow (1) of fluid hydrocarbons will normally come from one or more drilling hole wells and will be relatively warm and will be under pressure. It may sometimes be advantageous to attain a lower pressure and temperature in fluid flow (1) by passing the fluid flow through a choke (2) before introducing the fluid flow into separator (3). Choke (2) may be any type of choke.

The gas phase (4), from separator (3), will normally contain vapour hydrocarbons and water vapour. The gas phase (4)

is conveyed into a system (5), which in the embodiment in FIG. 3 is illustrated by use of the reactor system with feedback loop (10, 11, 12, 13, 14, 16) as described in U.S. Pat. No. 6,774,276 and which is hereby included by reference in its entirety. In FIG. 3, the gas phase fluid flow (4) is conveyed to a reactor (10), where it is mixed with cold (temperature below the melting temperature of the gas hydrate) fluid (16) from a separator (15). Said cold fluid (16) from the separator (15) contains particles of dry hydrate.

Water vapour and heavier hydrocarbon components which are present in the gas phase (4), will condensate at cooling in reactor (10). As described in U.S. Pat. No. 6,774,276, this water will moisten hydrate (16) from the separator (15) in the reactor (10) and in the cooler (11). In the reactor (10) and cooler (11) the water which moistens the hydrate will be converted to hydrate. New hydrate which is formed will accordingly grow on the hydrate particles from the separator (15) and also form new hydrate particles when large hydrate particles break up. New hydrate seed may also be formed elsewhere in the reactor (10) and cooler (11).

Fluid flow (4) may be mixed with the slurry of liquid and gas hydrate particles (16) in different ways in reactor (10), including being bubbled through a liquid slurry column, or by any suitable mechanical or other means of mixing.

Sub-cooling (the actual temperature being lower than the hydrate equilibrium temperature) of the fluid (normally below 20° C.), is required in order to form hydrates. The sub-cooling for formation of hydrate in the reactor (10) is accomplished by adding cold fluid from the separator (15) and from cooler (11).

At the bottom of the ocean or under arctic conditions or in other cold environments said reactor (10) and said cooler (11) may be an uninsulated pipe. The cooler (11) may also be any type of cooler which even may be an integrated part of the reactor (10).

In the separator (12) dry gas is separated from the resulting fluid flow from reactor/cooler (10), (11) and conveyed out to further processing and/or transport through e.g. a pipeline (6) for export to a central platform or to shore. The temperature in separator (12) may be allowed to be near or slightly above (usually 0.5 to 5° C. dependent on the total pressure) the minimum temperature (usually −2 to 4° C.) in the export pipeline (6), as it is known from the literature that partial water vapour pressure over hydrate is less than over water/ice. Separator (12) may be any type of separator.

Residual fluid from separator (12) is recycled through a line (13) by means of a pump (14) to a separator (15). The pump (15) may be any type of pump, able to handle the hydrate particles. The pump may also be situated before separator (12). One or more pumps or compressors may also be placed anywhere in the system (3) to (17).

In separator (15) excess hydrates and hydrocarbon condensate, which need not be mixed with (4), is separated from the fluid phase and conveyed through pipeline (7') (as a liquid slurry phase) to separator (3). A further pump may be included in the line (7'). Residual amounts of the total amount of hydrate particles and residual fluid from the separator (15) are recycled through a line (16) to the reactor (10). A further cooler may be included in the line (16). Excess hydrocarbon fluids may also be conveyed from separator (15) to pipeline (6) through a line (17). Separator (15) may be any type of separator and may include any devices for concentrating hydrate particles from fluid flow (13) to the liquid slurry phase in fluid flow (7). Separators (12) and (15) may be combined in one separator.

The third separator (15), with the flows (7) and (16) as effluents, may be constructed in such a way as to let the larger part (usually above 80 volume %) of the flow (13) go in line (16). The concentration of hydrate particles in flows (7) and (16) may be similar, or may be intentionally made different by different separator designs, depending on the system being treated. The separator (15) may also include an outlet (17) for hydrocarbon liquid. The hydrocarbon liquid (17) may also contain surplus gas hydrate particles, which may be mixed with the dry gas flow (6) for transport.

In separator (3) any hydrate particles from the fluid flow (7) from separator (15) will melt to water and gas components when the temperature in the separator is above hydrate equilibrium temperature (normally above 20° C.). The melting process of hydrates will decrease the temperature of the fluid from fluid flow (1).

Water from separator (3) is conveyed to line (9) where it may be injected into a reservoir, or depressurized, cleaned and released to the surroundings.

Hydrocarbon liquid fluid from separator (3) may be taken out and conveyed to a line (8) where it may be depressurized and stored or cooled and conveyed to pipeline (6).

The liquid fluid phase in the loop from reactor (10) to line (16) may originate from condensed liquid hydrocarbons from fluid flow (1) or any other fluid suitable for the process.

Salt water may be added to the said loop ((10) through (16)) in order to further decrease the partial water vapour pressure (water dew point) over hydrate in the second separator (12). The effect of having hydrates formed from the water phase and thus increasing the concentration of salt, will enhance the effect that lowers the water dew point, making it more difficult to precipitate hydrate at downstream locations, thus creating a better protection against lower temperatures and possible water condensation elsewhere in the system. The salt additions may also contribute beneficially in controlling particle size (small) and surface area (large), as described in U.S. 61/312,790 belonging to the applicant of the present invention and which is hereby included by reference. Salt (or other thermodynamic inhibitors) in the system will have specific effects which may be controlled to achieve certain results, as described below.

Salt or salt water may be added to systems without salt, or with salt concentrations below 3 volume %, in order to regulate the amount of hydrates which are formed (through thermodynamic inhibition), and to also make sure that the process of crystal growth always takes place at or near hydrate equilibrium (each particle will be in local equilibrium with its immediate surroundings). This ensures that there is a buffer against sudden changes (e.g. when a water slug or similar enters the system). What is also achieved, is that any further growth is also at or near equilibrium, ensuring that the growth habit is in the form of regular solid crystals rather than dendrites or other crystal forms which may enclose water and/or be prone to mechanical agglomeration due to the growth form.

Hydrate particle sizes may also be controlled in a similar manner, by adjusting the salt level. More salt will result in smaller particles, while less salt leads to larger ones.

Hydrate slurry in line (7') may be countercurrent in a cooler to fluid flow in line (4) in order to cool fluid in line (4) before entering reactor (10) and melt hydrates in line (7') before entering separator (3).

The invention may be placed subsea, on a platform or onshore. Part of the invention, e.g. separators (3) and parts of system (5) (FIG. 3), e.g. (12) and (15) and pump (14) in FIG. 3, may in an offshore field be placed on e.g. a platform/ship while e.g. reactor (10) and cooler (11) in FIG. 3 may be e.g. an uninsulated pipeline at the sea bottom.

The invention may be applied to a hydrocarbon fluid stream (1) of any pressure capable of forming gas hydrates.

Water dew point in fluid flow (6) may after separator (12) be further decreased by any suitable means, e.g. by molecular sieves, if wanted or needed.

In e.g. a gas/condensate field, satellite wells may be connected to (10) or (11) without any previous treatment, only limited by the hydrate melting capacity in separator (3).

Further possible embodiments of the present invention can be illustrated through the following examples. This is not a comprehensive list of possible implementations, and is included here to serve as informational examples only, and in no way should be seen as constricting future or alternative embodiments.

Example 1

Gas Production from an Offshore Field with a Production Platform or Ship (or Onshore Gas Production in a Cold Region)

An implementation of the present invention might consist of the following steps:

- The gas production is choked down to a suitable pressure, if needed.
- The gas and any liquid first passes through a warm (usually above 20° C.) separator (which is also used to melt excess hydrate from later process steps).
- Gas (4) and condensate (8) from the warm separator (3) pass on to the mixing point (10)(FIG. 3), where they meet a cold (usually −2 to 8° C.) gas hydrate slurry (16) from a cold separator (15)
- The mixture is flowed through a pipeline (11) which utilizes heat exchange with cold outside water (or air) as a means of cooling.
- Whenever suitable, satellite wells may be connected to the flow (11) with shorter or longer tie-backs, or alternatively be lead into the warm separator (3) as extra production stream (directly from the satellite to the platform).
- The line (11), where the fluids are cooled, and hydrates will precipitate, ends in the cold separator (12) on the platform, with a properly cooled mixture (usually around −2 to 8° C.) where the water has been precipitated as gas hydrates (or concentrated to a higher salinity according to hydrate equilibrium conditions)).
- The gas outlet (6) from the cold separator (12) consists of cooled gas, dry enough for direct export from the platform (water being removed into hydrate, and water dew point being further lowered (depending on gas composition, pressure and temperature) by any remainder of high salinity (according to hydrate equilibrium conditions) water in the loop (11) and cold separator (12)
- Saline water may if needed be added as formation water from the warm separator (3), sufficiently clean seawater, or by direct salt injection, in order to achieve beneficially lower water dew point and/or smaller particle sizes and more particle surface area, and to avoid water inclusions.
- The surplus condensate (17) from the cold separator (15) may also be transported with the gas in the export pipeline (6). It may contain a small (less then 5 volume %) fraction of hydrate particles, but not enough to appreciably influence the flow conditions.
- The flow pattern in the export pipe (6) may, if needed, be controlled in such a way as to minimize the potential for deposition and build-up of hydrate particles, e.g. through ensuring annular flow.
- Hydrate slurry from the cold separator (15) is pumped to the previously mentioned mixing point (10), where it meets the gas (4)/condensate (8) flow from the warm separator (3), and starts the cooling flow loop (11).
- Concentrated (usually above 10 volume %) hydrate slurry from the cold separator (15) may be pumped to the warm separator (3) for melting back to gas, condensate, and water. (Further concentration of the slurry in e.g. a cyclone may be advantageous before injecting it into the warm separator (3)).
- The water which is separated out in the warm separator (3) will contain minimal amounts of hydrocarbons, and may probably be re-injected directly into the reservoir formation, or discharged to sea after any needed cleaning.

Example 2

Gas Production from a Subsea Installation

For most purposes in this embodiment, the process flow will be the same as described in Example 1 above. The main difference is that all equipment is moved subsea, to a central location where production from the most gas-rich and formation water rich production wells are gathered, allowing enough heat to apply the melting step for excess hydrate slurry in the warm separator (3). The remaining production wells (less gas, less formation water) may be simply phased into cooling loop (11) through shorter or longer tie-backs.

Example 3

Oil Production from a Subsea Installation, or a Platform, with Processing Possibilities Both Subsea and Topsides An implementation of the present invention is in many respects identical to the preceding, and might include, but not limited to, the following steps:

- The production flow (1), containing oil, gas, water, and/or condensate, is choked (2) down to a suitable pressure, if needed.
- The fluid flow (1) first passes through a warm (usually above 20° C.) separator (3) (which is also used to melt excess hydrate from later process steps).
- Liquid hydrocarbon (8) and gas (4) (containing water vapour) from the warm separator (3) pass on to the mixing point (10) (FIG. 3), where they meet a cold (usually −2 to 8° C.) gas hydrate slurry (16) from a cold separator (15)
- The mixture is flowed through a pipeline (11) which utilizes heat exchange with cold outside water (or air) as a means of cooling.
- Whenever suitable, satellite wells may be connected to the flow (11) with shorter or longer tie-backs, or alternatively be lead into the warm separator (3) as extra production stream (directly from the satellite to the platform).
- The line (11), where the fluids are cooled, and hydrates will precipitate, ends in the cold separator (12) on the platform (or alternatively subsea), with a properly cooled mixture (usually around −2 to 8° C.) where the water has been precipitated as gas hydrates (or concentrated to a higher salinity according to hydrate equilibrium conditions)).
- The gas outlet (6) from the cold separator (12) consists of cooled gas, dry enough for direct export, as in previous examples. Alternatively, the gas may be flared or otherwise disposed of.

The oil and condensate (17) from the cold separator (15) may be transported in an export pipeline (6). It may contain a small (less then 5 volume %) fraction of hydrate particles, but not enough to appreciably influence the flow conditions. The dried gas (6) may be combined with this flow if desired.

Hydrate slurry (16) from the cold separator (15) is pumped to the previously mentioned mixing point (10), where it meets the oil/condensate (8) and gas (4) flow from the warm separator (3), and starts the cooling flow loop (11).

Concentrated (usually above 10 volume %) hydrate, slurry from the cold separator (15) may be pumped to the warm separator (3) for melting back to oil, gas, and water. It may be concentrated by extra means (e.g. a cyclone) in order to minimise return of hydrocarbon liquid. The cold separator (15) is therefore advantageously situated in close physical proximity to the warm separator (3).

The water which is separated out in the warm separator (3), which will be the majority of the water in the system, will contain minimal amounts of hydrocarbons, and may probably be re-injected directly into the reservoir formation, or discharged to sea after any needed cleaning.

A number of other combinations or variations of the aspects of the present invention will be evident to persons skilled in the art, and fall within the scope of the present invention, which is to be determined from the following claims.

The invention claimed is:

1. A method for treating a fluid hydrocarbon flow containing water, wherein the fluid hydrocarbon flow is a production flow from at least one wellbore, said method comprising:

introducing the fluid hydrocarbon flow into a first separator, and introducing a first fluid flow into the first separator, wherein the first fluid flow is a liquid phase which includes gas hydrates, and wherein a temperature in the first separator is above 20° C. so as to melt the gas hydrates into free water;

separating out most of the free water from the fluid hydrocarbon flow and the first fluid flow in the first separator, such that a remainder flow of the fluid hydrocarbon flow and the first fluid flow is taken out of the first separator and introduced into a converting system;

converting, in the converting system, free/condensed water in the remainder flow to gas hydrates; and thereafter separating a resulting fluid flow from the converting system into at least the first fluid flow and a second fluid flow, wherein the first fluid flow is directly recycled into the first separator, and wherein the second fluid flow having a content of dry gas and/or condensate/oil is conveyed for transport in a pipeline.

2. The method according to claim 1, wherein the production flow is a production flow from a gas field.

3. The method according to claim 1, wherein the production flow is a production flow from a gas field, and wherein said separating out of at least free water from the fluid hydrocarbon flow and the first fluid flow in the first separator comprises separating out free water and liquid condensate from the fluid hydrocarbon flow and the first fluid flow, such that the remainder flow includes a gas phase.

4. The method according to claim 1, wherein the first fluid flow includes gas hydrate particles and condensate/oil.

5. The method according to claim 1, further comprising: melting the gas hydrates in the first fluid flow to free water and/or free gas/condensate/oil in the first separator.

6. The method according to claim 2, further comprising increasing a temperature in the first separator.

7. The method according to claim 1, wherein the first fluid flow is used as a counter current flow cooling the remainder flow of the fluid hydrocarbon flow from the first separator before the remainder flow enters the converting system.

8. The method according to claim 1, further comprising:

separating out an excess water aqueous phase from the first separator; and either (i) re-injecting the excess water aqueous phase into a reservoir, or (ii) depressurizing the excess water aqueous phase, cleaning the excess water aqueous phase of hydrocarbons, and releasing the excess water aqueous phase to the surroundings.

9. The method according to claim 1, further comprising:

separating out condensate/oil from the fluid hydrocarbon flow and the first fluid flow in the first separator; and either (i) storing the separated condensate/oil at a field, (ii) transporting the separated condensate/oil in a ship or a separate pipeline, or (iii) mixing the separated condensate/oil with the first fluid flow or the second fluid flow downstream of the converting system.

10. The method according to claim 1, further comprising:

separating out dry gas or dewatered oil/condensate from the first separator; and either further processing the dry gas and/or dewatered oil/condensate or providing the dry gas and/or dewatered oil/condensate to a pipeline for transport.

11. The method according to claim 1, further comprising:

adding salt to the remainder flow of the fluid hydrocarbon flow so as to decrease a partial water vapor pressure (water dew point) over hydrate and control growth of the hydrates.

12. The method according to claim 11, wherein said adding of the salt is one of (i) adding formation water from the first separator to the remainder flow of the fluid hydrocarbon flow, (ii) adding seawater to the remainder flow of the fluid hydrocarbon flow, and (iii) directly injecting salt into the remainder flow of the fluid hydrocarbon flow.

13. The method according to claim 1, further comprising:

decreasing a water dew point in the second fluid flow with at least one molecular sieve.

14. The method according to claim 1, wherein the converting system includes a reactor and a heat exchanger, wherein said converting of free/condensed water in the remainder flow to gas hydrates includes:

mixing the remainder flow in the reactor with particles of gas hydrates introduced into the reactor; and cooling an effluent flow of hydrocarbons from the reactor in the heat exchanger, wherein said separating of the resulting fluid flow from the converting system includes:

treating the effluent flow from the heat exchanger in a second separator so as to separate the effluent flow into the first fluid flow and the second fluid flow; and further separating a third fluid flow from the first fluid flow, wherein the third fluid flow is recycled to the reactor to provide the particles of gas hydrates, and wherein a remaining part of the first fluid flow is recycled into the first separator.

15. The method according to claim 14, wherein the first fluid flow introduced into the converting system as part of the remainder flow originates from condensed liquid hydrocarbons from the fluid hydrocarbon flow.

16. The method according to claim 14, wherein the first fluid flow includes a first concentration of gas hydrates and the third fluid flow includes a second concentration of gas hydrates, wherein the first concentration is less than the second concentration.

17. The method according to claim 16, wherein the second concentration of gas hydrates is larger than 0.5 vol %.

18. The method according to claim 1, further comprising: adding salt to the converting system and increasing a concentration of salt in the remainder flow so as to decrease a partial water vapor pressure (water dew point) over hydrate and control growth of the hydrates.

19. The method according to claim 14, further comprising: adding salt to the converting system and increasing a concentration of salt in the remainder flow or the third fluid flow so as to decrease a partial water vapor pressure (water dew point) over hydrate and control growth of the hydrates.

20. The method according to claim 1, further comprising: after said separating of the resulting fluid flow from the converting system into at least the first fluid flow and the second fluid flow, transporting the second fluid flow having a content of dry gas and/or condensate/oil in a pipeline to a platform or to shore.

* * * * *